United States Patent [19]

Thorpe et al.

[11] Patent Number: 4,661,118

[45] Date of Patent: Apr. 28, 1987

[54] METHOD FOR OXIDATION OF PYRITE IN COAL TO MAGNETITE AND LOW FIELD MAGNETIC SEPARATION THEREOF

[75] Inventors: Arthur N. Thorpe, Washington, D.C.; Frank E. Senftle, Chevy Chase, Md.; Corrinne C. Alexander, Washington, D.C.

[73] Assignee: The United States of America, as represented by the Secretary of the Interior, Washington, D.C.

[21] Appl. No.: 726,253

[22] Filed: Apr. 15, 1985

[51] Int. Cl.[4] ..... C22B 1/11; C01G 49/08; B03C 1/00

[52] U.S. Cl. ..... 44/1 SR; 75/7; 201/17; 209/8; 209/11; 423/152; 423/154

[58] Field of Search ..... 209/3, 8, 11, 38, 213–215; 75/6, 7; 44/1 SR; 423/151, 152, 153, 154; 201/17

[56] References Cited

U.S. PATENT DOCUMENTS

| | | | |
|---|---|---|---|
| 1,053,486 | 2/1913 | Etherington | 423/151 X |
| 2,045,226 | 6/1936 | Goetz | 75/6 |
| 2,528,552 | 11/1950 | Royster | 209/8 X |
| 2,726,148 | 12/1955 | McKinley et al. | 44/1 SR |
| 2,945,755 | 7/1960 | Schulz | 75/7 X |
| 3,128,173 | 4/1964 | Gresham | 423/152 |
| 3,288,588 | 11/1966 | Bunge et al. | 75/7 X |
| 3,463,310 | 8/1969 | Ergun et al. | 209/8 |
| 3,671,197 | 6/1972 | Mascio | 75/6 X |
| 3,938,966 | 2/1976 | Kindig et al. | 44/1 SR |
| 4,120,665 | 10/1978 | Kindig et al. | 44/1 SR |
| 4,252,638 | 2/1981 | Bender et al. | 209/8 X |
| 4,260,394 | 4/1981 | Rich | 75/6 X |
| 4,368,176 | 1/1983 | Abishev et al. | 75/7 X |

FOREIGN PATENT DOCUMENTS

| | | | |
|---|---|---|---|
| 0485768 | 12/1975 | U.S.S.R. | 44/1 SR |

*Primary Examiner*—Randolph A. Reese
*Assistant Examiner*—Edward M. Wacyra
*Attorney, Agent, or Firm*—E. Philip Koltos; Thomas Zack

[57] ABSTRACT

A method for increasing the magnetization of pyrite-containing pulverized coal comprises heating the coal in an atmosphere of inert gas, desirably nitrogen, containing 3 to 60 torr, preferably 12 to 16 torr, partial pressure of air to a temperature in the range 390° to 455° C., desirably 400° to 410° C., for a time sufficient, preferably 2 minutes to 2 hours, for converting enough pyrite to magnetite to allow separation of at least 50% by weight of the pyrite from the coal in a low-strength magnetic field. The sulfur content of coal treated in accordance with this method can be reduced by subjecting the treated coal to a low-strength magnetic field for moving at least 50% by weight of the pyrite from the coal although a smaller fraction, about 5 to 25%, of the pyrite is actually converted to magnetite.

23 Claims, 4 Drawing Figures

METHOD FOR OXIDATION OF PYRITE IN COAL TO MAGNETITE AND LOW FIELD MAGNETIC SEPARATION THEREOF

DESCRIPTION

1. Technical Field

The present invention relates to pyrite-containing coal and, more particularly, to a method for partially converting pyrite in coal to magnetite for enhancing the magnetic properties of the pyrite.

2. Background Art

There have been continuing efforts over the years to alleviate the energy crises in the United States by substituting relatively inexpensive, very abundant coal for relatively expensive, fairly scarce fuel oil as an energy source whenever possible. One major stumbling block is the air pollution problem which results from burning most coals. In this regard, it is the sulfur in the coal which presents the most serious pollution problem. It has been estimated that the sulfur content of coals burned by public utilities in the United States for steam and electricity generation results in the discharge into the atmosphere of millions of tons of sulfur, mostly as sulfur dioxide.

Sulfur is found in coal both in the organic and inorganic forms. Organic sulfur is chemically bonded into the hydrocarbon structure of the coal and cannot generally be removed by physical or mechanical means. Inorganic sulfur occurs mainly as pyrite, iron sulfide, and can be removed from the coal by a variety of separation methods. However, pyrite is difficult to remove from coal in a practical, economical way suitable for public or commercial use on a large scale. For example, the use of high intensity magnetic field separators (10,000–20,000 Oe or higher) can substantially reduce the pyrite concentration in water or liquid hydrocarbon slurries of pulverized coal, but the very high magnetic fields and equipment needed make this a very expensive and, thus, commercially impractical method. See, for example, U.S. Pat. No. 4,081,251. Because pyrite is only slightly magnetic, other separation methods focus on altering the magnetic properties of the pyrite to enhance its magnetic susceptibility prior to magnetic separation. For example, in U.S. Pat. No. 3,961,971 a kaolin clay having improved brightness is prepared by removing a portion of the iron pyrite contaminants therefrom according to a process in which the clay is roasted in air at 400°–600° C. and formed into an aqueous slurry after which the slurry is subjected to a magnetic field of at least 2.4 kilogauss (approx. 2,400 Oe) and then leached. No explanation of the chemical conversion achieved by roasting is offered, but it is hypothesized that at least some pyrite is converted to magnetically susceptible oxides of iron. In U.S. Pat. No. 4,052,170, a process for magnetic desulfurization of coal is taught which includes the steps of heating the coal with hot oxygen-containing gas to 480°–600° C. to enhance the magnetic susceptibility of the pyrites and removing the pyrites in an at least 10 kilogauss (approx. 10,000 Oe) magnetic separation means. Although this process purports to enhance the magnetic susceptibility of the pyrites, it nevertheless requires the use of impractically high intensity magnetic separators. In another magnetic separation process, taught in U.S. Pat. No. 4,466,362, no effort is made to convert the pyrite. Rather, an effort is made to remove pyritic sulfur from coal by converting weakly magnetic hexagonal pyrrhotite associated with the pyrite to more strongly magnetic monoclinic pyrrhotite and then removing the latter in a magnetic separator.

It has, of course, been appreciated that certain iron oxides, for example magnetite, have such a vastly greater magnetic susceptibility than pyrite that conversion of the pyrite to one of these forms would permit separation of pyrite from pulverized coal without recourse to high-gradient magnetic fields. However, the chemistry explaining the oxidative conversion of pyrite ($FeS_2$) shows that the formation of magnetite ($Fe_3O_4$) is an intermediate stage prior to conversion to hematite ($\alpha$-$Fe_2O_3$) and, insofar as has been shown to date, the presence of any significant amount of magnetite is only transient. For example, heating pyrite to 700°–900° C. in an atmosphere containing $SO_2$, $O_2$ and $N_2$ in which the partial pressure of oxygen is 0.01–0.03 atm is known to cause the pyrite to be first converted to a non-stoichiometric sulfide, then to magnetite and finally to hematite. See, Nishihara et al, *Studies of the Oxidation of Pyrite I, II and III,* 20 Mem. Fac. Eng. Kyoto Univ. 285–334 (1979). In air at 400°–500° C., pyrite is converted directly to hematite or decomposes to hematite after passing through a sulfate intermediate stage. See, e.g., Marusak et al, 50 J. App. Phys. 7807 (1979). When the air is depleted in oxygen up to 600° C., a small amount of magnetite, in addition to hematite, is observed. See, Kopp et al, 43 Am. Min. 1079 (1958). It has also been noted that pyrite can be converted to at least some magnetite by roasting the pyrite at 500°–600° C. in an atmosphere of CO, $H_2$ and $SO_2$ containing a limited amount of air. See Hassialis, Chapter 13 of *Handbook of Mineral Dressing* (1948). Although it has been suggested by at least one observer that the mixture of sulphates and oxides formed during the oxidation of $FeS_2$ depends on various factors, such as the oxygen partial pressure, temperature and particle size (see, e.g., Attar, 57 Fuel 201 (1978), this observation is, of course, no more than was ascertainable from the known chemistry. No method has ever been suggested which effects a significant net conversion of pyrite to magnetite, i.e., without loss of the great proportion of magnetite formed by subsequent oxidation to hematite.

It is, therefore, the purpose of the present invention to overcome previously encountered difficulties and to provide a unique, efficient and highly practical method for effectively converting at least a significant portion of the pyrite in pulverized coal to magnetite for enhancing the magnetic properties of the pyrite. This allows the pyrite to be separated from the coal in a practical and economic manner by use of a relatively low field (up to 2,000–3,000 Oe) magnetic separator and provides an effective method for measuring the amount of pyrite in the coal.

DISCLOSURE OF THE INVENTION

In one aspect of the present invention, this is accomplished by providing a method for increasing the magnetization of pyrite in pulverized coal comprising the steps of heating the pulverized coal in an inert atmosphere containing a small amount of air at 390°–455° C. for a time sufficient for partially converting the pyrite to magnetite.

In another aspect of the present invention, the temperature, partial pressure of air, and coal particle size are controlled to achieve maximum pyrite conversion in a commercially reasonable period of time.

In still another aspect of the present invention, there is provided a method for reducing the sulfur concentration in pulverized coal comprising the steps of converting at least a portion of the pyrite in the coal to magnetite and separating the magnetite from the remainder of the coal in a low-strength (up to 2,000–3,000 Oe) magnetic field.

In yet another aspect of the present invention, the pyrite is converted to magnetite by heating pyrite-containing pulverized coal, preferably having particle sizes predominantly in the range 35–3,2000 microns, in an inert, preferably nitrogen, atmosphere containing air at a partial pressure in the range 3 to 60 torr, preferably 12 to 18 torr, at a temperature of 390° to 455° C., preferably at least 400° C. and desirably 400°–410° C., for a time sufficient to allow separation of at least 50% by weight of the pyrite from the coal in a low-strength magnetic field, preferably two minutes to two hours.

BRIEF DESCRIPTION OF THE DRAWINGS

The invention will be better understood from the following description and appended claims considered together with the accompanying drawings in which:

BEST MODE FOR CARRYING OUT THE INVENTION

Figure 1:
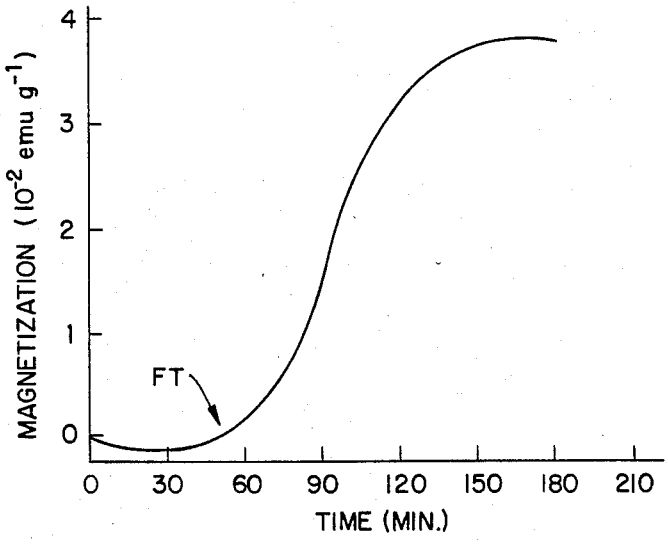
FIG. 1 illustrates graphically the change in magnetization as a function of time of a pyrite-containing coal sample treated in accordance with the method of the present invention.

In accordance with the present invention, it has been noted that the reaction temperature and the atmosphere to which the pyrite particles are exposed during oxidative conversion to magnetite are critical factors in controlling the extent of the conversion reaction. Thus, it has been found that in an inert atmosphere, which can be helium, nitrogen or any other, but, for economic reasons, is preferably nitrogen, if the oxygen concentration is low and the temperature is relatively low, then the $Fe_{1-x}S$ (where x may range from 0 to 0.5) initially formed from the pyrite will first be oxidized to magnetite ($Fe_3O_4$) and then a portion thereof will be further oxidized to hematite ($\alpha$-$Fe_2O_3$). The reactions leading to magnetite are summarized as follows:

$$(1-x)FeS_2+(1-2x)O_2 \rightarrow Fe_{1-x}S+(1-2x)SO_2 \quad (1)$$

$$2Fe_{1-x}S+(3-x)O_2 \rightarrow 2(1-x)FeO+2SO_2 \quad (2)$$

$$3FeO+\tfrac{1}{2}O_2 \rightarrow Fe_3O_4 \quad (3)$$

If, however, the temperature and/or oxygen concentration is too high, the magnetite state will not be seen and hematite will be formed according to the following reaction:

$$2Fe_3O_4+\tfrac{1}{2}O_2 \rightarrow 3Fe_2O_3 \quad (4)$$

It has been noted that at reaction temperatures of 390° C. and above in an anoxic atmosphere, pyrite showed significant changes in magnetization and, by controlling the temperature and oxygen (air) concentration, the extent of conversion to magnetite as well as the extent of the subsequent conversion of magnetite to hematite can be controlled. In this way, the magnetization of the oxidized pyrite particles can effectively be predetermined and controlled, allowing separation thereof in a low strength magnetic field.

The process can be better understood from consideration of the following specific example of its practice.

A sample of bituminous coal having the following analysis in weight percent on a moisture-free basis: 5.0% H, 81.6% C, 1.4% N, 3.4% O, 1.7% S (of which 1.09% was derived from pyrite), 1.28% Fe, was ground to less than 100 mesh. The sample was suspended in a quartz basket in a sealed system which was evacuated and an inert helium atmosphere containing 18 torr of air was added to reach a total pressure of 600 torr. The sample region was heated by an external furnace and the temperature increased in increments of 30°–80° C. until the final temperature (FT) setting of 408° C. was attained. About 10 minutes was allowed at each temperature increment for the sample to approach, if not attain, equilibrium. Magnetization measurements were made at each temperature increment and, after the final temperature was reached, every ten (10) minutes. FIG. 1 shows the change in magnetization of the bituminous coal specimen as a function of time of heating at 408° C. in a helium atmosphere containing 18 torr partial pressure of air. The time at which the final temperature setting was attained is indicated by the letters FT. It appears from the data that the magnetization of the sample began to change at about 390° C., at which temperature the conversion of the pyrite to magnetite began to become detectable as an increase in sample magnetization (see FIG. 1). After attaining the final temperature setting at 408° C., magnetization increased rapidly, indicating conversion of pyrite to magnetite. The rate of increase of magnetization slowed between 90 and 120 minutes and the magnetization appears to have peaked at about 0.038 $e.m.u.g^{-1}$. The slowing in the rate of increase of magnetization is due to a slowing of the rate of conversion of pyrite to magnetite, an increase in the rate of conversion of magnetite to hematite or, more likely, a combination of the two.

Figure 2:
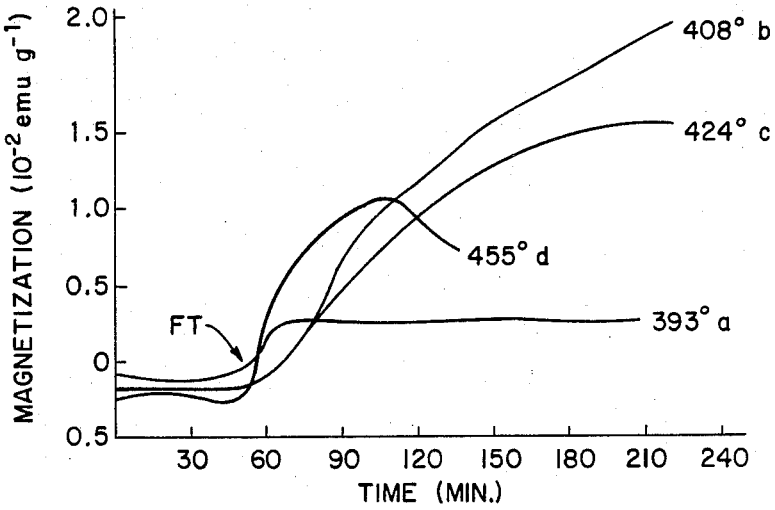
FIG. 2 illustrates graphically the change in magnetization as a function of time of a clean pyrite-containing coal sample treated at various temperatures in accordance with the method of the present invention.

The rate and extent of conversion from pyrite to magnetite and from magnetite to hematite are influenced by temperature as shown in FIG. 2 which illustrates a series of isobaric curves showing the change in magnetization of the bituminous coal sample used in FIG. 1 with time of heating for several temperatures in a helium atmosphere containing 12 torr partial pressure of air. A small change in magnetization was observed at 393° C., but the highest magnetization was noted when the temperature was 408° C. At temperatures higher than 408° C., the maximum magnetization attained was lower. At 424° C., a peak in the curve was just visible at about 200 minutes and, at 455° C., the curve peaked in about 100 minutes. Observations from heating coal at different temperatures (390°–455° C.), but at the same partial pressure of air, thus indicate substantial differences in maximum magnetization and indicate the impact of the competing conversion reactions on the magnetization of the sample.

It is believed that the reaction kinetics of $FeS_2$ is largely controlled by the diffusion of sulfur in the pyrite crystal. Thus, at 393° C. the temperature is too low for significant diffusion to take place, and only a thin veneer of $Fe_3O_4$ is produced on the pyrite surface. Further, the temperature is too low for significant conversion of $Fe_3O_4$ to $Fe_2O_3$ (equation 4). The result is a small increase in magnetization which does not change rapidly with time of heating. A temperature of 408° C. is sufficiently high to cause a significant diffusion of sulfur to the surface resulting in a thickening of the $Fe_3O_4$ layer and a substantial increase in the magnetization with time. At 424° C. the conversion of $Fe_3O_4$ to $Fe_2O_3$ becomes significant, and the magnetization is attenuated with time. At 455° C. the two conversion processes are accentuated so that the magnetization curve peaks in about a 100 minutes.

To demonstrate the effect of air partial pressure (and thus oxygen content) on the oxidative conversion of pyrite in coal to magnetite, a series of measurements were made at the temperature of highest magnetization (408° C. in FIG. 2) in helium atmospheres containing various partial pressures of air, increasing in partial pressure from 6 to 12 to 18 torr. The isothermal curves A, B, C shown in FIG. 3 (solid line curves) are for samples of the same bituminous coal used in FIG. 2 and indicate that more and more $Fe_3O_4$ was formed as the air (oxygen) concentration was increased. At the highest partial pressure, 18 torr, the oxidation of $Fe_3O_4$ to $Fe_2O_3$ is evident from the down turn of the curve. From a practical point of view, the concentration of oxygen must be high enough to react with the pyrite present to form $Fe_3O_4$ but yet be low enough so as not to significantly oxidize the $Fe_3O_4$ formed, i.e., to maximize the net amount of $Fe_3O_4$ formed without significantly oxidizing the organic part of the coal.

Figure 3:
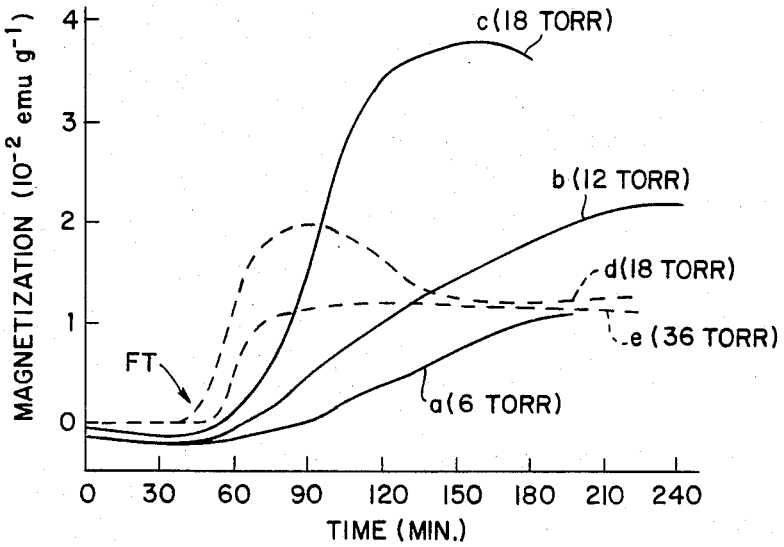
FIG. 3 illustrates graphically the change in magnetization as a function of time of pyrite-containing coal and hydrothermal pyrite samples treated in atmospheres containing various air partial pressures in accordance with the method of the present invention.

For comparison with the bituminous coal specimens of FIG. 3, the change in the magnetization of hydrothermal pyrite, when heated in a helium atmosphere containing 18 and 36 torr of air, is shown by the dashed curves D and E in FIG. 3. The magnetization of the hydrothermal pyrite at 18 torr partial pressure of air increased rapidly to a maximum value of 0.02 e.m.u.g.$^{-1}$, and, with time, decreased to a steady value of 0.012 e.m.u.g$^{-1}$ (curve D). This behavior indicates: (1) a very rapid rate of formation of $Fe_3O_4$ initially; (2) subsequent rapid oxidation of $Fe_3O_4$ to $\alpha$-$Fe_2O_3$; and (3) no significant oxidation after a certain amount of $\alpha$-$Fe_2O_3$ is formed. At 36 torr partial pressure of air, another sample of the same hydrothermal pyrite showed an increase in magnetization to a steady value of 0.012 e.m.u.g$^{-1}$ (curve E). The behavior of this sample suggests that at the higher partial pressure of oxygen, the rate of oxidation of $Fe_3O_4$ to $\alpha$-$Fe_2O_3$ increased significantly so that the initial rapid formation of $Fe_3O_4$ was offset. As a result, the magnetization was lower and did not pass through a maximum value. The final value of the magnetization in curve E is about the same as in curve D. The fact that the final magnetization in curves D and E are approximately the same and that no significant oxidation takes place after 150 minutes further suggests that once a complete layer of $\alpha$-$Fe_2O_3$ is formed, oxygen no longer has access to the underlying $Fe_3O_4$.

Figure 4:
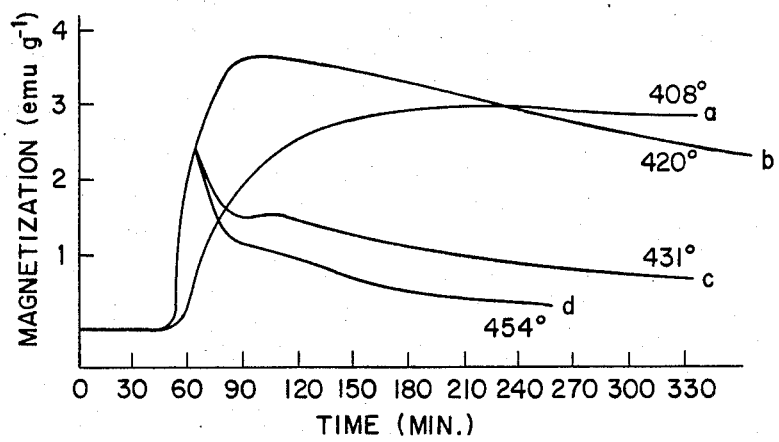
FIG. 4 illustrates graphically the change in magnetization as a function of time of clean pyrite treated at various temperatures in accordance with the method of the present invention.

The effect of temperature on the magnetization of pyrite as a function of time is shown in FIG. 4 for clean pyrite (separated from the Upper Freeport coal seam) at 36 torr partial pressure of air. It is noteworthy that at 408° C. the curve is similar in shape but the magnetization is very significantly larger than for the hydrothermal pyrite shown in curve E of FIG. 3 under the same temperature-air partial pressure conditions. This is believed due to the hydrothermal pyrite having significantly less surface area than the Upper Freeport pyrite. As will appear more clearly hereinafter, the pyrite conversion is thought to be essentially a reaction occurring at the surface of each pyrite grain, i.e., a surface phenomena. Therefore, all else being equal, a sample having less surface area will have less conversion of pyrite to magnetite. In this connection, although particle size (and therefore surface area) is not critical from the standpoint of effecting the conversion, it is a factor in the rate and extent of the conversion. From the standpoint of commercial practicality, it is preferable for the pulverized coal or pyrite treated in accordance with the present invention to have particle sizes predominantly in the range 35 to 3,200 microns. If the particles are too small, they will tend to compact and restrict the flow of gas to the surface. If the particles are too large, they will provide a relatively smaller surface area for reaction.

Referring again to FIG. 4, it can be seen that if the temperature is increased only 12° C. (curve B), the time to attain saturation is markedly shortened, and the broad maximum magnetization shown by curve A is enhanced and sharpened. Thus, increasing the temperature increases both the rate of formation of $Fe_3O_4$ and that of $\alpha$-$Fe_2O_3$. At higher temperatures (curves C and D), the magnetization increased so rapidly once the final temperature was attained that it was difficult to obtain meaningful data points between 55 and 65 minutes. However, it is estimated that the sharp maximum magnetization obtained between 55 and 65 minutes at these two temperatures was considerably in excess of 4.0 e.m.u.g$^{-1}$. The data in FIG. 4 and other test data indicate that the formation of $Fe_3O_4$ is enhanced relative to that of $\alpha$-$Fe_2O_3$ by increasing the temperature above 408° C. or by lowering the pressure of air to less than 36 torr.

The available data suggests a conversion mechanism whereby more sulfur initially diffuses to the pyrite surface forming $SO_2$ (via equations (1) and (2) and a layer enriched in $Fe_{1-x}S$ and FeO is formed on the surface of the pyrite grain. The FeO is not stable and rapidly oxidizes to $Fe_3O_4$ (via equation (3)). At the same time, the $Fe_3O_4$ on the outside surface further oxidizes to $\alpha$-$Fe_2O_3$ via equation (4). During heating, the $\alpha$-$Fe_2O_3$ layer will thicken and reduce the magnetization. However, once the $\alpha$-$Fe_2O_3$ layer is formed and attains a given thickness, it impedes the diffusion of oxygen to the $Fe_3O_4$ below.

From the magnetization curves, it may be inferred that initially $Fe_3O_4$ rapidly forms a thin layer on the pyrite surface. Almost at the same time, $Fe_3O_4$ starts to oxidize to $\alpha$-$Fe_2O_3$ on the outside surface. The relative rate of formation and oxidation of $Fe_3O_4$ depends on the temperature and partial pressure of air. If the temperature and air partial pressure are low (e.g., curve A, FIG. 3), both the diffusion of sulfur to the surface and oxygen through the $\alpha$-$Fe_2O_3$-$Fe_3O_4$ layer is slow, and the amount of $Fe_3O_4$ does not increase significantly. If the temperature is maintained moderately low (e.g., 408° C.) but the air partial pressure increases, an $\alpha$-$Fe_2O_3$-$Fe_3O_4$ layer is formed on the pyrite grains (FIG. 3) so that the $Fe_3O_4$ increases more rapidly than the $\alpha$-$Fe_2O_3$.

However, once the $\alpha$-$Fe_2O_3$ outside layer is complete, the supply of oxygen to the $Fe_3O_4$, FeO, and $Fe_{1-x}S$ just below the surface is sharply attenuated. Additional oxidation is minimal. If the temperature is subsequently increased, the reaction rate of all reactions increases. The result is a sharper maximum in the magnetization curve (e.g., curves B, C and D, FIG. 4).

It is apparent that the rate of formation of $Fe_3O_4$ (equations (1)–(3)) is a more significant function of temperature than the oxygen partial pressure, whereas the reverse is true for the $\alpha$-$Fe_2O_3$ producing reaction (equation (4)). To obtain a suitable build-up of $Fe_3O_4$ from pyrite in coal, therefore, the coal should be heated to a relatively low temperature, preferably 400°–410° C., at a low partial pressure of air, preferably 12–18 torr. At high oxygen concentrations or at slightly higher temperatures, the magnetite formation and its subsequent conversion to $\alpha$-$Fe_2O_3$ is so rapid that the magnetite step is not observed, as hereinbefore discussed.

If this oxidation model of pyrite in coal is reasonably accurate, and if the fraction of pyrite converted to $Fe_3O_4$ is essentially the same from sample to sample, then by heating different coals under constant conditions of temperature and air pressure, the specific magnetization should be approximately proportional to the total pyritic sulfur in the coal. The data indicate that indeed this is the case, and the resulting straight line relation implies that under similar conditions of heating, the thickness of the $Fe_3O_4$ crust formed on the pyrite surface is approximately the same average thickness from sample to sample, even though the thickness on individual grains may vary significantly.

INDUSTRIAL APPLICABILITY

The oxidative conversion method of the present invention is broadly applicable to all forms of pyrite-containing coal, as well as to separated pyrite and hydrothermal pyrite. Although only a portion of the pyrite is converted to magnetite, from about 5% to 25% of the total pyrite present, depending on the coal sample, the extent of the pyrite surface exposed, etc., the magnetite forms as a crust on a much larger percentage of the pyrite grains. The magnetization of $Fe_3O_4$ is sufficiently large that the partially converted grains of pyrite can be removed by means of a low-intensity field (up to 2,000–3,000 Oe) magnetic separator. To demonstrate this capability, a sample of pulverized coal (Sample A) and three samples of coal fines (Samples B, C, D), all less than 100 mesh, were heated to maximum magnetization at 408° C. in a helium atmosphere containing 18 torr of air. The magnetic particles were hand separated using a small 500 Oe magnet enclosed in a glass tube. Table I shows that, except for one sample, greater than 70% by weight of the original pyrite was removed by the 500 Oe field.

TABLE I

| Sample | Original % $FeS_2$ | % $FeS_2$ Removed |
|---|---|---|
| A | 4.79 | 75 |
| B | 0.67 | 79 |
| C | 9.95 | 60 |
| D | 5.16 | 81 |

This confirms that low field magnetic separation is an economic and practical method of reducing the sulfur concentration in pulverized coal and, therefore, presents a method of reducing sulfur air pollution resulting from the burning of coal to generate power. It is believed that in order to be practically useful, the conversion of pyrite to magnetite should be sufficient to allow separation of at least 50% by weight of the pyrite from the coal in a low-strength magnetic field. The method is particularly significant since it employs conventional and relatively inexpensive furnaces and magnetic separators and can be practiced at the power station immediately prior to burning.

We claim:

1. A method for increasing the magnetization of pyrite-containing pulverized coal comprising the steps of:

heating the coal in an atmosphere having an inert gas that is inert to pyrite containing 3 to 60 torr partial pressure of air to a temperature in the range of 390° C. to 455° C. for at least two minutes for converting sufficient pyrite to magnetite to allow separation of at least a portion of the pyrite from the coal in a low-strength magnetic field.

2. A method, as claimed in claim 1, wherein said coal is heated for a time sufficient to convert enough of the pyrite in said coal to magnetite to allow separation of at least 50% by weight of the pyrite from the coal in a low-strength magnetic field.

3. A method, as claimed in claim 2, wherein said coal is heated to a temperature in the range 400° to 410° C.

4. A method as claimed in claim 2, wherein said atmosphere contains 12 to 18 torr partial pressure of air.

5. A method, as claimed in claim 2, wherein the pulverized coal particle sizes are predominantly in the range 35 to 3,200 microns.

6. A method, as claimed in claim 2, wherein the inert gas is nitrogen.

7. A method, as claimed in claim 2, wherein at least 5% by weight of the pyrite in said coal is converted to magnetite.

8. A method, as claimed in claim 2, wherein said pulverized coal having particle sizes predominantly in the range 35 to 3,200 microns is heated in an atmosphere containing 12 to 18 torr partial pressure of air to a temperature of at least 400° C.

9. A method, as claimed in claim 8, wherein at least 5% by weight of the pyrite in said coal is converted to magnetite.

10. A method, as claimed in claim 8, wherein sufficient pyrite is converted to magnetite to increase the magnetization of the coal to at least about 0.012 e.m.u.$g^{-1}$.

11. A method, as claimed in claim 1, wherein sufficient pyrite is converted to magnetite to increase the magnetization of the coal to at least about 0.012 e.m.u.$g^{-1}$.

12. A method for reducing the sulfur concentration of pyrite-containing pulverized coal comprising the steps of:

(a) converting at least a fraction of the pyrite in the coal to magnetite for increasing the magnetization of the coal; and (b) magnetically separating at least a portion of the pyrite from the coal in a low-strength magnetic field;

said step of converting pyrite to magnetite including heating the coal in an atmosphere having an inert gas that is inert to pyrite containing 3 to 60 torr partial pressure of air to a temperature in the range 390° C. to 455° C. for at least two minutes.

13. A method, as claimed in claim 12, wherein at least 50% by weight of the pyrite is magnetically separated from the coal.

14. A method, as claimed in claim 13, wherein said coal is heated for a time sufficient to convert enough of the pyrite to magnetite to allow separation of at least 50% by weight of the pyrite from the coal.

15. A method, as claimed in claim 14, wherein said coal is heated to a temperature in the range 400° to 410° C.

16. A method, as claimed in claim 14, wherein said atmosphere contains 12 to 18 torr partial pressure of air.

17. A method, as claimed in claim 14, wherein the pulverized coal particle sizes are predominantly in the range 35 to 3,200 microns.

18. A method, as claimed in claim 14, wherein the inert gas is nitrogen.

19. A method, as claimed in claim 14, wherein at least 5% by weight of the pyrite in said coal is converted to magnetite.

20. A method, as claimed in claim 14, wherein said pulverized coal having particle sizes predominantly in the range 35 to 3,200 microns is heated in an atmosphere containing 12 to 18 torr partial pressure of air to a temperature of at least 400° C.

21. A method, as claimed in claim 20, wherein at least 5% by weight of the pyrite in said coal is converted to magnetite.

22. A method, as claimed in claim 20, wherein sufficient pyrite is converted to magnetite to increase the magnetization of the coal to at least about 0.012 e.m.u.$g^{-1}$.

23. A method, as claimed in claim 12, wherein sufficient pyrite is converted to magnetite to increase the magnetization of the coal to at least about 0.012 e.m.u.$g^{-1}$.

* * * * *